US006577697B2

(12) United States Patent
Pearcy et al.

(10) Patent No.: US 6,577,697 B2
(45) Date of Patent: Jun. 10, 2003

(54) FIELD ANALYSIS OF GEOLOGICAL SAMPLES USING DELAYED NEUTRON ACTIVATION ANALYSIS

(75) Inventors: English C. Pearcy, San Antonio, TX (US); Mark S. Jarzemba, Sante Fe, NM (US); James R. Weldy, San Antonio, TX (US)

(73) Assignee: Southwest Research Institute, San Antonio, TX (US)

( * ) Notice: Subject to any disclaimer, the term of this patent is extended or adjusted under 35 U.S.C. 154(b) by 0 days.

(21) Appl. No.: 10/100,704

(22) Filed: Mar. 19, 2002

(65) Prior Publication Data

US 2003/0068001 A1 Apr. 10, 2003

Related U.S. Application Data

(60) Division of application No. 09/265,723, filed on Mar. 9, 1999, which is a continuation-in-part of application No. 08/890,187, filed on Jul. 9, 1997, now abandoned.

(51) Int. Cl.[7] ..... G21G 1/06

(52) U.S. Cl. ..... 376/159; 376/114; 376/161; 376/160; 376/162; 376/189; 376/191; 376/192; 376/193; 376/202; 376/342; 376/347; 250/493.1; 250/496.1; 250/390.1; 250/506.1; 250/320.07; 250/392; 250/492.1; 250/507.1; 250/253; 250/255

(58) Field of Search ..... 376/114, 159, 376/161, 160, 162, 189, 191, 192, 193, 202, 342, 347; 250/493.1, 496.1, 390.1, 505.1, 390.07, 392, 492.1, 506.1, 507.1, 253, 255

(56) References Cited

U.S. PATENT DOCUMENTS

| | | | | | |
|---|---|---|---|---|---|
| 2,302,247 | A | | 11/1942 | Neufeld | 250/83.6 |
| 2,303,709 | A | | 12/1942 | Siegert | 250/83.6 |
| 2,440,999 | A | | 5/1948 | Anderson | 250/84 |
| 3,008,047 | A | | 11/1961 | Earley et al. | 250/83 |
| 3,018,374 | A | | 1/1962 | Pritchett | 250/71.5 |
| 3,035,173 | A | * | 5/1962 | Koch et al. | 376/154 |
| 3,072,549 | A | | 1/1963 | Koutz et al. | 204/193.2 |
| 3,164,525 | A | | 1/1965 | Wetch et al. | 176/33 |
| 3,197,375 | A | * | 7/1965 | Borst | 376/171 |
| 3,212,982 | A | | 10/1965 | Astley et al. | 176/40 |
| 3,290,220 | A | | 12/1966 | Mitault et al. | 176/15 |
| 3,349,001 | A | | 10/1967 | Stanton | 176/11 |
| 3,463,922 | A | * | 8/1969 | Senftle et al. | 250/253 |
| 3,518,163 | A | | 6/1970 | de Boisblanc | 176/40 |
| 3,638,020 | A | | 1/1972 | Duffey et al. | 250/83.3 R |
| 3,648,515 | A | | 3/1972 | Youmans | 73/152 |
| 3,665,195 | A | | 5/1972 | Youmans | 250/83.3 R |
| 3,699,338 | A | * | 10/1972 | Baumann et al. | 250/391 |
| 3,711,714 | A | * | 1/1973 | Klar et al. | 376/254 |
| 3,786,258 | A | * | 1/1974 | Schmidt | 376/115 |
| 3,822,185 | A | | 7/1974 | Wetch et al. | 176/70 |
| 3,899,676 | A | | 8/1975 | Goldstein et al. | 250/390 |
| 3,942,003 | A | | 3/1976 | Apenberg et al. | 250/255 |
| 4,024,017 | A | * | 5/1977 | Fleck | 376/257 |
| 4,045,676 | A | | 8/1977 | Rolle | 250/272 |
| 4,208,580 | A | * | 6/1980 | Schweitzer et al. | 250/262 |

(List continued on next page.)

FOREIGN PATENT DOCUMENTS

| | | | |
|---|---|---|---|
| CH | 9807178 A | * | 8/1998 |
| EP | 0328408 | * | 10/1989 |

*Primary Examiner*—John Richardson
(74) *Attorney, Agent, or Firm*—Baker Botts L.L.P.

(57) ABSTRACT

A system and method for rapidly analyzing elemental abundances in rock or soil samples (14) under field conditions. The system uses a portable neutron source (12) to allow neutron activation analysis of elements having identifiable radioactive decay characteristics. A radiation detector (18) detects radiation released by the sample (14) and provides radiation testing results to an amplifier (26) for computing the concentration of trace elements in the sample with a high degree of accuracy.

14 Claims, 10 Drawing Sheets

U.S. PATENT DOCUMENTS 4,278,882 A * 7/1981 Clayton et al. ..... 250/255
4,317,993 A 3/1982 Hertzog, Jr. et al. ..... 250/270
4,340,443 A 7/1982 Clayton et al. ..... 376/342
4,355,001 A 10/1982 Pierart ..... 376/317
4,395,633 A * 7/1983 Mathew ..... 250/357.1
4,463,264 A 7/1984 Young et al. ..... 250/390
4,464,569 A 8/1984 Flaum ..... 250/270
4,483,816 A 11/1984 Caldwell et al. ..... 376/158
4,568,510 A 2/1986 Caldwell ..... 376/154
4,582,672 A * 4/1986 Tuley et al. ..... 376/215
4,588,547 A * 5/1986 Impink et al. ..... 376/214
4,645,635 A 2/1987 Yuen et al. ..... 376/245
4,645,935 A 2/1987 Salaita ..... 250/390
4,696,782 A 9/1987 Clayton et al. ..... 376/159
4,702,379 A 10/1987 Clayton et al. ..... 209/539
4,810,876 A 3/1989 Wraight et al. ..... 250/256
4,822,552 A 4/1989 Ahmed et al. ..... 376/257
4,830,193 A 5/1989 Clayton et al. ..... 209/3.1
4,897,550 A 1/1990 Bernard et al. ..... 250/390.01
4,898,709 A 2/1990 Clayton ..... 376/159
4,920,548 A * 4/1990 Gaussa et al. ..... 250/336.1
5,002,721 A 3/1991 Bernard et al. ..... 376/159
5,097,123 A 3/1992 Grau et al. ..... 250/270
5,160,696 A * 11/1992 Bowman ..... 376/170
5,162,095 A 11/1992 Alegre et al. ..... 376/159
5,225,149 A * 7/1993 Banda ..... 376/255
5,237,594 A 8/1993 Carroll ..... 376/160
5,258,622 A 11/1993 Pratt, Jr. ..... 250/390.05
5,388,128 A 2/1995 Gozani ..... 376/159
5,410,575 A 4/1995 Uhm ..... 376/159
5,471,057 A 11/1995 Herron ..... 250/269.6
5,513,226 A * 4/1996 Baxter et al. ..... 376/170
5,757,510 A 5/1998 Okada ..... 250/269.1
5,767,510 A 6/1998 Evans ..... 250/269.1
6,233,298 B1 * 5/2001 Bowman ..... 376/171
6,442,226 B1 * 8/2002 Venneri et al. ..... 376/170

* cited by examiner

| PARAMETER | SMALL ASSEMBLY | LARGE ASSEMBLY |
|---|---|---|
| $k_{eff}$ (± ONE STANDARD DEVIATION) | 0.80221 ± 0.00157 | 0.89837 ± 0.00093 |
| MEAN NEUTRON LIFETIME (ms) | 0.17 | 0.29 |
| TOTAL NUMBER OF FUEL RODS | 260 | 732 |
| URANIUM MASS (kg) | 583 | 2,627 |
| POLYETHYLENE MASS (MODERATOR PLUS BLANKET, kg) | 109 | 432 |
| HEIGHT AND DIAMETER (REACTOR PLUS BLANKET) | 60.96cm (38") | 96.52cm (24") |
| BLANKET THICKNESS (INCHES) | 3" | 2" |

*FIG. 7*

| SAMPLE GOLD CONCENTRATION – RELATIVE MASS ABUNDANCE (ATOMIC ABUNDANCE) | IRRADIATION TIME $\tau$ (h) | COUNTING TIME BEGINS $t_l$ (h) | COUNTING TIME ENDS $t_h$ (h) | INTEGRATED COUNTS I | STANDARD DEVIATION OF I FROM BACKGROUND SUBTRACTION $\sigma_{bs}$ | k (#/cm$^3$) | $\sigma_k$ (#/cm$^3$) |
|---|---|---|---|---|---|---|---|
| 10 ppm (1.4E16 #/cm$^3$) | 63.9 | 0.050 | 23.8 | 42,488 | 221 | $3.66\times10^{10}$ | $2.60\times10^{8}$ |
| 5 ppm (7.0E15 #/cm$^3$) | 47.5 | 0.050 | 24.7 | 17,147 | 153 | $3.77\times10^{10}$ | $4.42\times10^{8}$ |
| 1 ppm (1.4E15 #/cm$^3$) | 55.4 | 0.067 | 64.0 | 7,915 | 161 | $3.92\times10^{10}$ | $9.12\times10^{8}$ |
| 500 ppb (7.0E14 #/cm$^3$) | 65.7 | 0.067 | 24.0 | 2,004 | 97 | $3.98\times10^{10}$ | $2.12\times10^{9}$ |
| 100 ppb (1.4E14 #/cm$^3$) | 54.3 | 0.050 | 37.0 | 503 | 107 | $4.00\times10^{10}$ | $8.67\times10^{9}$ |
| 50 ppb (7.0E13 #/cm$^3$) | 112 | 0.050 | 29.3 | 438 | 95 | $3.00\times10^{10}$ | $6.64\times10^{9}$ |
| 10 ppb (1.4E13 #/cm$^3$) | 72.9 | 0.12 | 95.1 | 211 | 120 | $2.29\times10^{10}$ | $1.31\times10^{10}$ |
| VARIANCE WEIGHTED AVERAGE OF k ± ONE STANDARD DEVIATION (#/cm$^3$) | $3.70\times10^{10} \pm 8.92\times10^{8}$ | | | | | | |

*FIG. 8*

| USGS SAMPLE DESIGNATION (RELATIVE MASS ABUNDANCE, ppb) | IRRADIATION TIME $\tau$ (h) | COUNTING TIME BEGINS $t_l$ (h) | COUNTING TIME ENDS $t_h$ (h) | INTEGRATED COUNTS I | STANDARD DEVIATION OF I FROM BACKGROUND SUBTRACTION $\sigma_{bs}$ | MEASURED GOLD CONCENTARTION (STANDARD DEVIATION) (#/cm$^3$) | USGS REPORTED GOLD CONCENTARTION (STANDARD DEVIATION) (#/cm$^3$) |
|---|---|---|---|---|---|---|---|
| DGPM-1 (730) | 24.9 | 0.033 | 24.0 | 2,600 | 118 | $1.82\times10^{15}$ ($1.00\times10^{14}$) | $2.11\times10^{15}$ ($1.73\times10^{14}$) |
| GXR-2 (36) | 66.3 | 79.8 | 103.8 | 159 | 54 | $1.20\times10^{14}$ ($4.19\times10^{13}$) | $9.66\times10^{13}$ ($2.68\times10^{12}$) |
| SGR-1 (10) | 127.4 | 46.8 | 120.0 | 142 | 156 | $2.14\times10^{13}$ ($2.36\times10^{13}$) | $2.68\times10^{13}$ (NOT GIVEN) |

FIELD ANALYSIS OF GEOLOGICAL SAMPLES USING DELAYED NEUTRON ACTIVATION ANALYSIS

RELATED APPLICATION

The present application is a divisional of U.S. patent application Ser. No. 09/265,723, entitled "Field Analysis of Geological Samples Using Delayed Neutron Activity Analysis", filed Mar. 9, 1999, which is a continuation-in-part of U.S. patent application Ser. No. 08/890,187, entitled "System and Method for Field Elemental Analysis by Neutron Activation", filed Jul. 9, 1997 now abandoned.

TECHNICAL FIELD OF THE INVENTION

This invention relates in general to the field of mineralogical exploration and mining analysis, including the practice of analyzing field samples to determine the presence of a selected substance, and, more particularly, to a field portable system using neutron activation for detecting a desired element.

BACKGROUND OF THE INVENTION

The mineral exploration industry dedicates substantial resources to finding mineral deposits with concentrations of desired minerals that are large enough to allow economic extraction of desired minerals. To find such deposits, mining companies typically send individual technicians to field sites to take samples. Field sites are initially selected by indirect indications of deposits which may be obtained from geological indications such as visible host rock alteration or structural features. Technicians take rock and soil samples from each field site, label the samples according to their original location, and transport them to a laboratory for analysis. Laboratories use exact measurement techniques to determine the presence of desired elements in each sample. For instance, techniques such as mass spectrometry can precisely determine the chemical makeup of each sample. Based upon this laboratory analysis, a mining company may determine the feasibility of commercial extraction of the mineral resource. Often, however, additional testing of field sites having promising samples must occur to support the commercial exploitation decision.

Recent advances in the efficiency of extraction technologies allow economic extraction of certain precious metals from extremely low concentrations of mineral deposits. For example, the mineral exploration industry can now economically extract gold from subsurface deposits having gold concentrations of only tens of parts per million. These new technologies can also economically extract gold in open pit deposits in concentrations of less than one part per million. Thus, analysis of field samples should provide detection ranges for gold in the low parts per billion detection range. The industry may need similarly precise measurements for other elements.

Although laboratory analysis of field soil and rock samples provides accurate detection capability for trace concentrations of precious metals, laboratory analysis imposes a number of disadvantages. For instance, once a sample is taken from a field site, it may need to be transported long distances to an appropriate laboratory for analysis. En route or during transportation, the sample may be mislabeled or misidentified, leading to inaccurate results. From the time of shipping to the time at which results are available from the laboratory, several weeks may pass. Also, laboratory analysis typically includes input by third parties unrelated to the mineral exploration company, which can lead to security leaks when a concentration of a valuable element is discovered. In the time that it takes to obtain laboratory results, the mineral rights to a valuable property may be lost to commercial espionage.

SUMMARY OF THE INVENTION

In accordance with the present invention, a system and method is provided that substantially eliminates or reduces disadvantages and problems associated with previously developed methods for analyzing field rock and soil samples. The field sample is irradiated ex situ by exposure to a portable neutron source. The activated sample is then analyzed by a radiation detector to determine the spectrum of radiation it releases. The system compares the radiation spectrum against the spectrum that would occur with known concentrations of selected isotopes, allowing a determination of the concentration of the selected isotope in the sample.

More specifically, the present invention uses a portable neutron source, such as a moderator assembly or a subcritical reactor. Examples of potential neutron sources include californium 252, americium-beryllium, plutonium-beryllium, radium-beryllium. The moderator assembly is comprised of a moderator, a neutron source, an irradiation chamber. The subcritical reactor is comprised of the same elements with the addition of a fissile element such as uranium. The method includes placing a field sample in the irradiation chamber long enough to allow absorption of an adequate number of neutrons by nuclides of the desired element. The sample is then removed from the irradiation chamber and placed in a separate gamma ray detector, such as a high purity intrinsic germanium semiconductor detector, to allow detection of gamma ray radiation produced by the activated sample. The gamma ray detector is isolated from the neutron source to avoid interference from radiation produced by the neutron source. In one embodiment, the detector is placed in a detector shield to prevent interference from environmental gamma ray radiation. An analyzer, such as a multichannel analyzer and spectroscopy amplifier operating with a personal computer, provides the results of the gamma ray detector to a technician who can determine the presence and concentration of if selected elements in the field sample by determining the concentration of selected isotopes that decay and if produce gamma rays having predictable characteristics.

The present invention provides important technical advantages for mineral exploration. For instance, the present invention allows timely determinations of the concentration of trace elements in field samples by avoiding delays inherent to laboratory analysis, such as those caused by transport. Detection accuracy at field sites is adequate to allow determinations of the feasibility for commercial exploration of a given mineral resource. The accuracy can be easily adjusted to measure different concentrations of trace elements in accordance with the economic feasibility of mining each trace element. The detection of a number of elements is possible by varying the duration for which the sample is exposed to the neutron source and by measuring for different types of radiation. Secrecy of the results for each sample can be more easily maintained, and the results can be used to focus an investigation of a given field site at promising areas. Thus, mineral exploration companies can form, implement and modify exploration strategies and property purchase decisions in a timely manner as field test results become available. Additionally, the measurements provided by the present invention can enable differentiation among lithologic formations and can support geologic mapping for structural analysis, seismic risk studies, oil exploration and other purposes.

BRIEF DESCRIPTION OF THE DRAWINGS

FIG. 7 sets out the results of a first set of experiments, performed with $SiO_2$ samples doped with a gold chloride solution.

FIG. 8 sets out the results of a second set of experiments, performed with USGS standard gold-samples.

DETAILED DESCRIPTION OF THE INVENTION

System Overview

Neutron activation analysis (NAA) determines the presence and concentration of selected elements in a sample by measuring the characteristics of the radioactive decay of certain isotopes of the element. Typically, a linear accelerator is used to bombard a sample with neutrons. Nuclides of elements in the sample absorb the neutrons to become radioactively unstable isotopes. Linear accelerators provide a large supply of high energy neutrons to quickly activate the sample and allow rapid sampling. For instance, in U.S. Pat. No. 5,237,594 by Carroll and in U.S. Pat. No. 4,568,510 by Caldwell, a sample is irradiated in situ, meaning in its undisturbed position, by a linear accelerator. The linear accelerator is pulsed, or turned off and on incrementally, to allow measurement of the sample after it has been activated. Although the linear accelerators of Carroll and Caldwell provide a large flux of neutrons, the total flux over a time period is difficult to predict. Further, in situ sampling does not allow precise measurement of the activated sample due to variations in distance to the sample, the presence of environmental radiation, the necessity of measuring only prompt gamma radiation, and other variable factors.

Unstable isotopes in samples activated by neutrons from a linear accelerator are allowed to decay to a stable form and, during decay, release a variety of radiation. Different elements have different isotopes with unique decay characteristics. For instance, referring to FIG. 1, the radioactive decay characteristics of gold 198 are depicted. Naturally-occurring gold is 100% gold 197. When naturally-occurring gold absorbs a neutron to become gold 198, it becomes unstable and beta decays, releasing beta and gamma radiation having unique energy levels. By measuring this released radiation over a time, the concentration of gold in the original inactivated sample can be determined.

Figure 2:
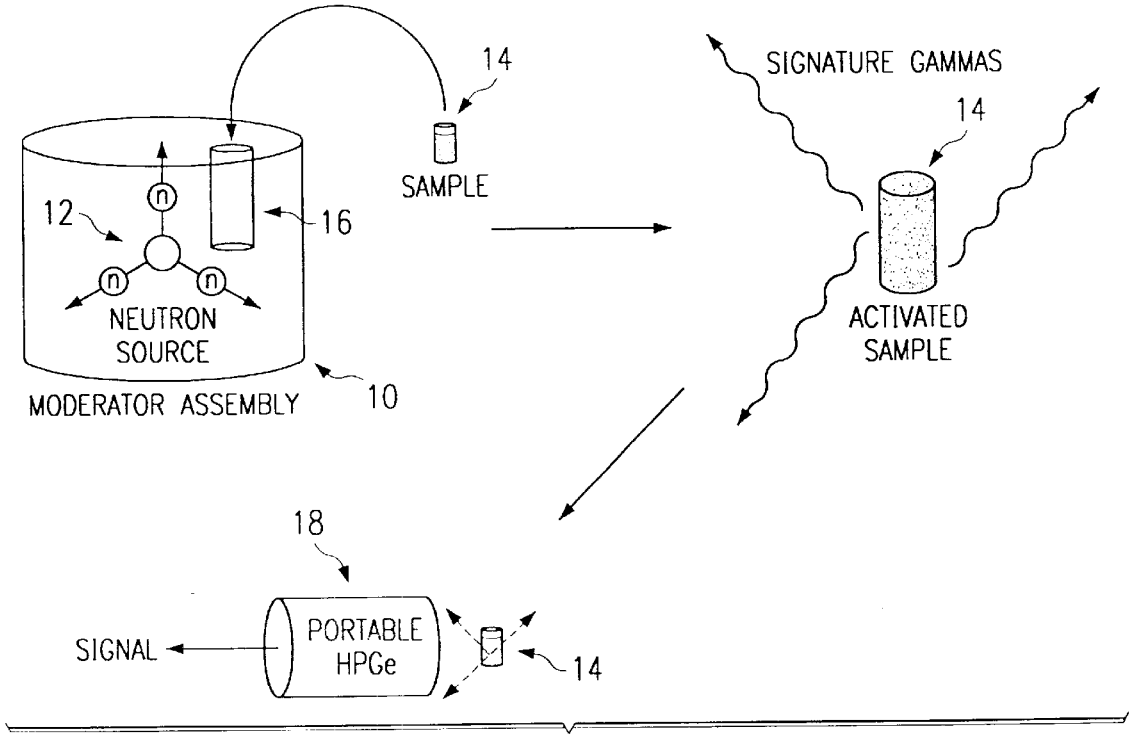
FIG. 2 is a diagram of field procedures used for neutron activation analysis with a portable neutron source in accordance with the invention.

FIG. 2 is a functional illustration of the present invention, used to measure trace element concentrations ex situ. Moderator assembly 10 holds a neutron source 12 adjacent to an irradiation chamber 16. Sample 14, which has a known and regular geometry, is placed in irradiation chamber 16 to allow sample 14 to absorb neutrons and become activated, meaning that an adequate number of nuclides of the desired element have absorbed a neutron and become radioactively unstable. The activated sample 14 is then placed proximate to a radiation detector 18 to allow measurement of the radiation resulting from the decay of unstable elements in the activated sample 14.

Neutron source 12 can include any substance that will produce a predictable flux of neutrons. For instance, a radionuclide or combination of radionuclides that decay through neutron emission, such as californium 252, americium-beryllium, plutonium-beryllium, or radium-beryllium, can be placed in a non-critical reactor having a medium for moderating the source neutrons. The moderating medium can be a material with low neutron-absorbing qualities, such as carbon, polyethylene, deuterium, water, liquid hydrocarbons, or solid hydrocarbons. Alternatively, a multiplying medium, such as uranium nuggets inserted in polyethylene, can create a subcritical reactor by operating in combination with a radionuclide neutron source to boost the neutron flux level within moderator assembly 10. Moderator assembly 10 may include a shielding material to prevent leakage of radiation to the environment. Sample 14 may be activated by exposure to neutron source 12 for a predetermined exposure time based upon the number of neutrons produced by neutron source 12, the neutron absorption cross section of the element or elements to be detected, the geometry of the moderator assembly and the desired accuracy of the analysis.

Figure 3:
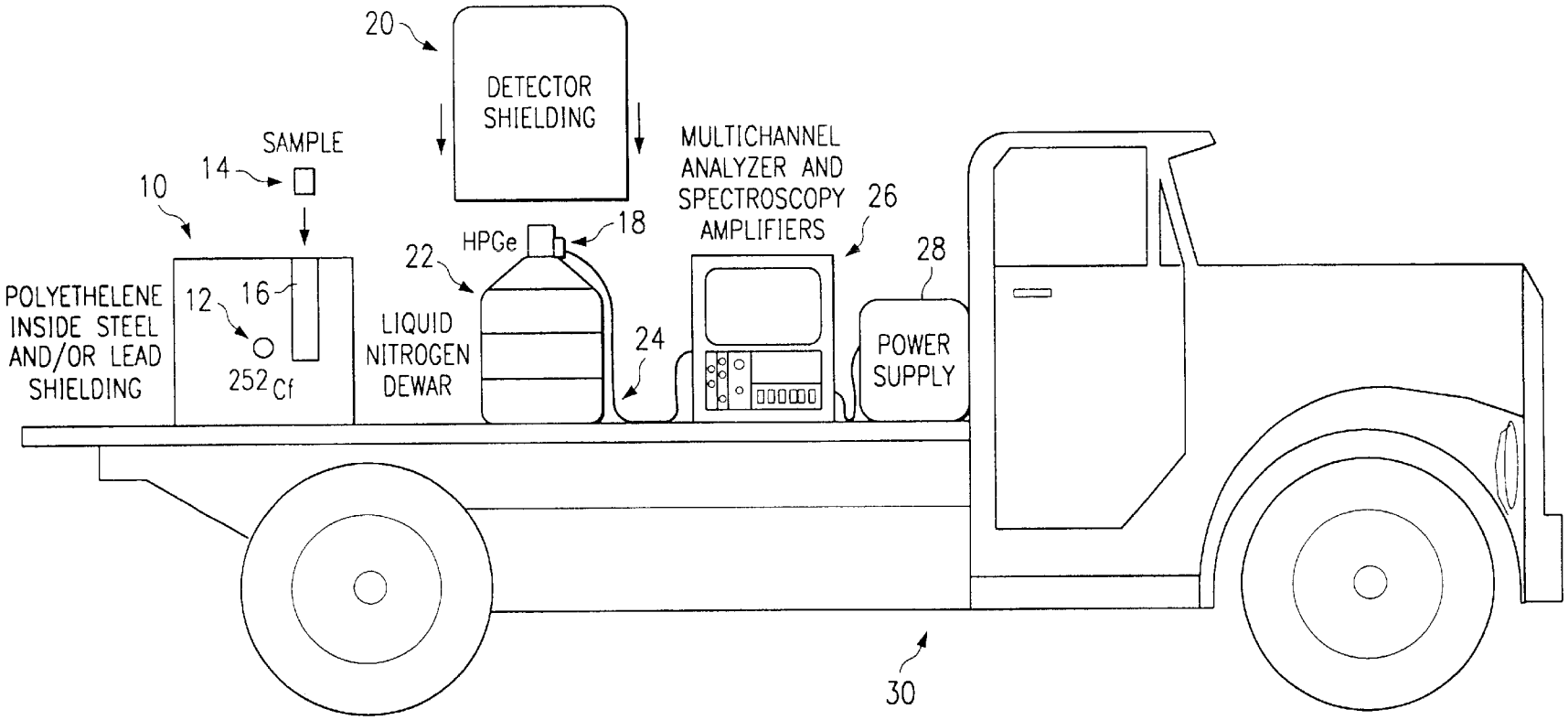
FIG. 3 is a side view of one embodiment of the invention, adapted for placement on a truck.

Referring now to FIG. 3, one embodiment of the present invention adapted for use in a field environment is depicted. Moderator assembly 10 is constructed of steel and/or lead shielding filled with polyethylene or some other hydrocarbon in its interior. A supply of californium 252 acts as neutron source 12 adjacent to irradiation chamber 16. A convenient opening allows access to irradiation chamber 16 in moderator assembly 10 for insertion of sample 14 for the predetermined exposure time. Once sample 14 becomes activated, it can be removed from moderator assembly 10 and analyzed with radiation detector 18. Detector shielding 20 fits over detector 18 to ensure that environmental and other radiation does not skew the results of detector 18. A supply of liquid nitrogen 22 maintains detector 18 at low temperatures for proper detector function. Detector 18 is coupled to a multichannel analyzer and spectroscopy amplifier 26 that includes a processor such as a personal computer. Analyzer 26 includes software that allows a technician to analyze the electrical signals produced by the detection of radiation from the activated sample 14. A convenient power supply 28 provides power to analyzer 26 for use in remote situations. The entire system can be mounted on truck 30 to allow testing to occur in field conditions.

In operation the present invention is adapted to travel to a field site, for instance, by mounting on truck 30. A neutron source 12 is selected to provide a supply of neutrons for activating samples. Although many radionuclides or combination of radionuclides could provide a neutron source, californium 252 is well adapted for field use. Californium 252 has a half-life of 2.65 years and therefore provides a fairly constant flux of neutrons over a normal field operation cycle without requiring replacement. The constant flux of neutrons allows greater predictability for the number of neutrons that will interact with a given sample over an exposure time.

Moderator assembly 10 is built to a size adequate to hold a supply of neutron source 12. Moderator assembly 10 is of a sturdy construction to prevent any leakage of radioactive material during relocations to field sites. For instance, a sturdy steel or lead casing encloses the neutron source and a medium for holding the neutron source firmly in place, even in the presence of shocks from movement in field conditions, while allowing neutrons to pass from the neutron source to the sample. For instance, polyethylene or composite materials made of hydrocarbons provide mediums that will not allow movement of the neutron source during movement of moderator assembly 10, will not crack or break, but will allow neutrons to pass through to irradiation chamber 16 with little interference. To enhance the production of neutrons by the neutron source, the medium can include multiplying media, such as uranium nuggets, which will absorb neutrons and then a fission to produce additional neutrons, thereby boosting the neutron flux level. In this way, a multiplying media can make a non-critical reactor containing only a neutron source into a sub-critical reactor with enhanced neutron output.

The present invention is transported by truck or other means to a field site. At the field site, a technician takes rock or soil samples from selected locations. Typically, the samples are approximately one-inch plugs having a uniform size. Irradiation chamber 16 can be adapted to accept appropriately-sized samples. When the technician wants to sample soil or rock outcroppings, such samples can be crushed and placed in a vial or other sample holder that matches the size of plugs produced from drilling. In this way, sample 14 has a constant cross section in irradiation chamber 16, which increases the predictability of the number of neutrons directed towards the sample from neutron source 12.

Sample 14 is placed in irradiation chamber 16, which is proximate to neutron source 12. In one embodiment, a plurality of irradiation chambers are disposed within moderator assembly 10, each irradiation chamber adapted to receive a predetermined number of neutrons from neutron source 12. Several neutron sources 12 can be placed around irradiation chamber 16 along with several rods, or any other convenient configuration. Sample 14 is exposed to neutron source 12 in irradiation chamber 16 for a predetermined exposure time which depends upon the strength of the neutron source, the geometry of moderator assembly 10, the accuracy of the measurement required, and the neutron absorption cross-section of the element of interest. The exposure time can vary from minutes to hours according to variations in the above factors, and can be calculated and provided to the technician by software loaded on a personal computer in analyzer 26. For instance, the exposure time of a sample being tested for the presence of gold would be reduced by gold's relatively high neutron capture cross-section of 98.8 barns, but increased by the low concentrations at which gold is likely to be measured to determine the feasibility of economic extraction.

Figure 1:
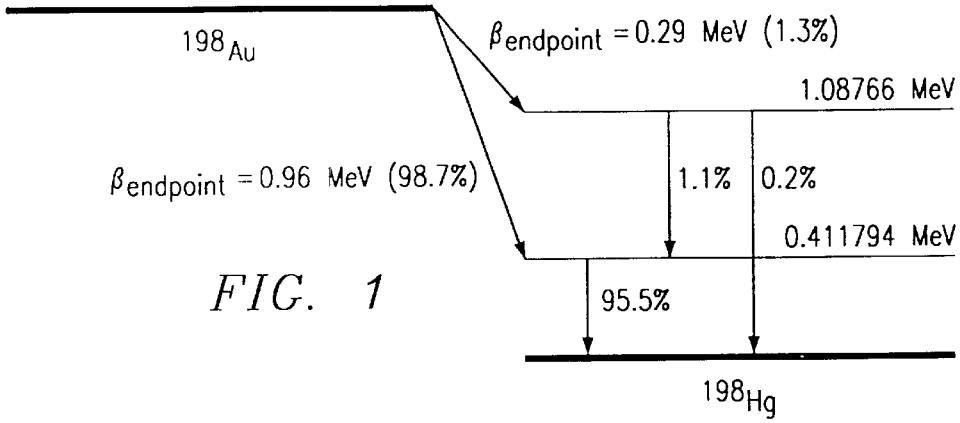
FIG. 1 is a diagram of the radioactive decay scheme for gold 198.

Once the sample 14 has had an adequate exposure time, it can be removed from moderator assembly 10 and placed in radiation detector 18. Radiation detector 18 will detect radiation, such as gamma radiation or beta radiation, exiting from activated sample 14 as radioactive isotopes in sample 14 decay. For instance, gamma rays having an energy level of 0.411794 MeV would indicate that gold 197 present in the field sample was activated to gold 198 and then decayed into mercury 198, as is depicted in FIG. 1. Activated sample 14 is placed directly on radiation detector 18 for a testing time which varies according to the degree of activation of sample 14 by exposure to nuclear source 12, the half-life of the isotope being detected and the desired accuracy of the reading. For instance, gold 198 has a half-life of 2.70 days. Thus, a given gamma ray flux density having energy levels of 0.411794 MeV over a given period of time for a given sized sample with a given exposure time will indicate a sample having a specific quantity of gold. The testing time can be calculated and provided to the technician by software loaded on analyzer 26.

A number of radiation detectors can be used to detect radiation from radioactive decay ex situ to analyze trace element compositions, but a high-purity, intrinsic germanium semi-conductor gamma detector which accepts activated sample 14 directly on its surface will provide a highly accurate count of the gamma ray radiation commonly released during radioactive decay. The function of this radiation detector necessitates cooling, such as can be obtained from liquid nitrogen. The accuracy is further enhanced if the sample 14 is isolated during testing, as can be accomplished with a lead or steel detector shielding that covers radiation detector 18 and separates radiation detector 18 from moderator assembly 10. In field conditions, a technician can perform each of these steps with little training or supervision. Other embodiments may use a beta ray or alpha ray detector.

A technician can use the results of field samples to build a profile for a field site. The timely feedback provided by the present invention allows the technician to concentrate a field search in a promising area during a single visit to the field site. The technician can provide test data to decision makers for prompt decisions regarding property investments without the risk that testing information will be compromised to competitors. The accuracy of the testing can be easily adapted according to the accuracy required for a desired mineral. For instance, gold can be tested for in small concentrations by lengthening the exposure time and testing time as needed. Other elements, such as silver, cobalt, mercury, sodium, potassium, silicon, cadmium, magnesium, or manganese, can be tested for in larger concentrations as needed. The testing process itself leaves no permanent residue, as could result from chemical testing, since the radiation used is of a relatively low concentration level. Further, the testing method requires minimal training since the exposure time, testing time, and concentration calculations can be programmed into a personal computer incorporated in amplifier 26. In addition, a small personal computer will require very little power and, thus, the present invention can easily be used in field conditions for extended periods of time with a small power supply and relatively low operating costs.

Sample Geometry and Moderator Assembly

As indicated above, samples taken from the field are first processed to provide a controlled geometry and to enhance the ability to detect smaller amounts of the substance of interest. Solid samples are powdered, and the resulting particles are mixed. The result is a "homogenous" sample, that is, a sample whose constituents are evenly distributed throughout the sample. For irradiation, the sample is placed in a vial 14, which gives it a regular geometry. For example, a cylindrical vial 14 provides a cylindrical sample geometry. Thus, the cross-section of the sample is constant, in terms of both geometry and make-up.

Figure 4:
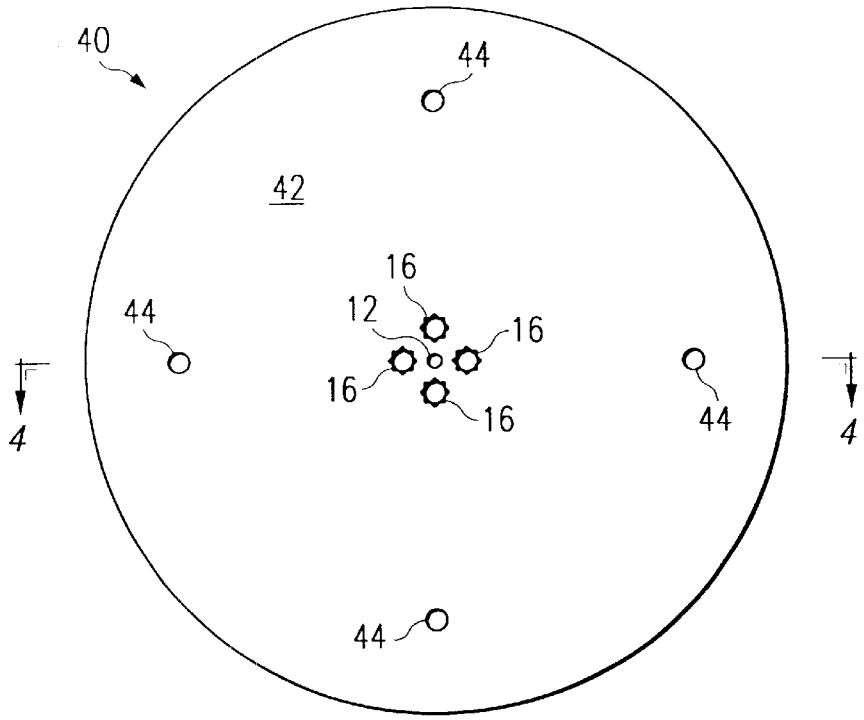
FIGS. 4 and 5 illustrate an example of a moderator assembly.
Figure 5:
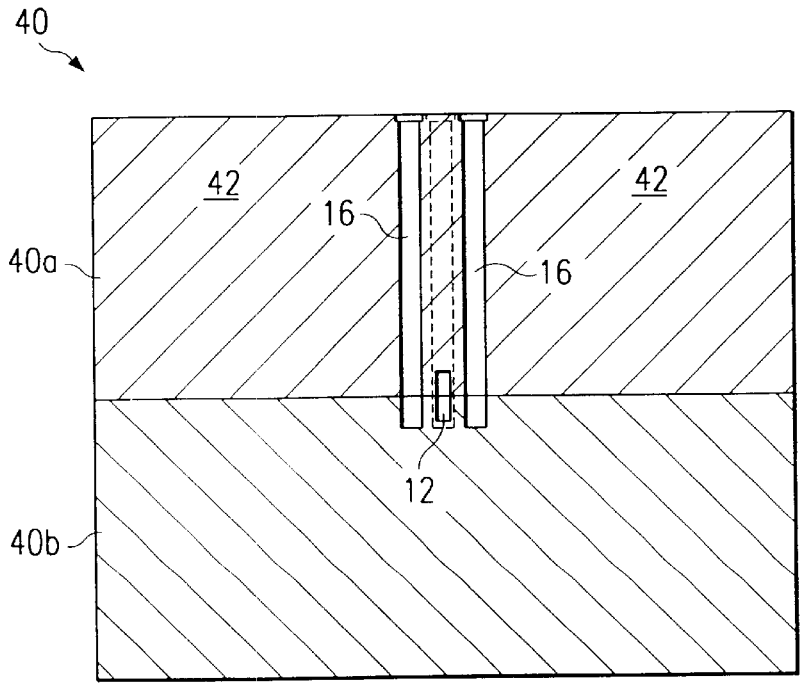

FIGS. 4 and 5 are a top view and cross sectional view, respectively, of a neutron moderator 40. Moderator 40 is suitable for use as the moderator assembly 10 of FIG. 2. Referring again to FIG. 2, such a moderator assembly 10 contains the neutron source 12 and has at least one irradiation chamber 16 for containing one or more sample vials 14 during sample activation.

As illustrated in FIGS. 4 and 5, moderator 40 is cylindrical in shape. It is primarily comprised of a moderating medium 42 having low neutron absorption and high neutron scattering properties, such as the various materials described above. These materials "moderate" the neutrons so as to increase their interaction with the sample. The materials may be liquid or solid, with a common characteristic being a presence of hydrogen. In the example of FIGS. 4 and 5, the moderating medium 42 is polyethylene.

In the case of a liquid medium 42, moderator 40 has an outer casing (not shown) for containing the liquid. Otherwise, an outer casing is optional, but may be desired to provide radiation shielding.

The use of a solid medium 42 permits the medium itself to provide the structural support for neutron source 12 and sample vials 14. Thus, neutron source 12 may simply be placed inside moderator 40, at the center. Four irradiation chambers 16 symmetrically spaced around neutron source 12 permit insertion of sample vials 14. Polyethylene rods (not shown) may be inserted above the vials 14 to provide neutron reflection and to prevent streaming of neutrons from the chambers 16.

Optionally, moderator 40 can be fitted with multiplying media. As explained above, this results in sub-critical enhancement of the neutron flux levels. An example of a subcritical reactor of this type is described below.

In the example of FIGS. 4 and 5, moderator 40 has a top portion 40*a* and a bottom portion 40*b*. These parts can be separated, to permit insertion of neutron source 12. As an example of suitable dimensions of moderator 40 (oversized from the standpoint of neutron economy), its outer diameter might be 24 inches and its height might be 20 inches. Neutron source 12 is at the center of moderator 40, and the sample chambers 16 are spaced a radial distance of 1 inch from the center. Although a two or three inch thickness of medium 42 would be sufficient for neutron reflecting purposes, the additional thickness of medium 42 provides increased shielding.

Figures 6, 13:
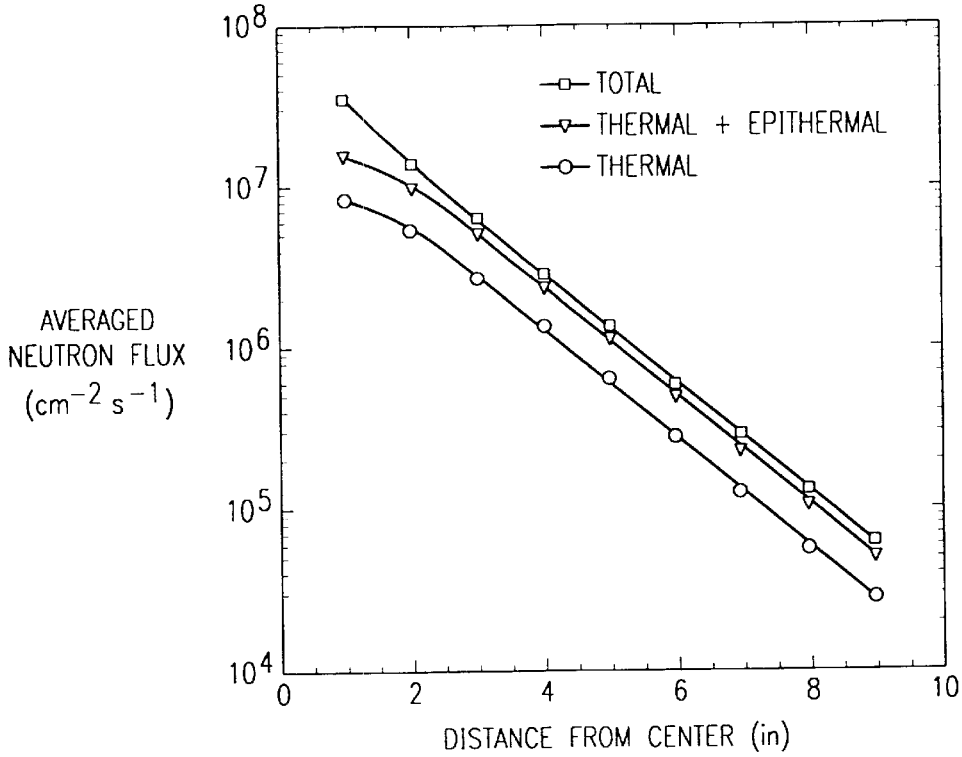
FIG. 6 illustrates the neutron flux in the moderator as a function of distance from a neutron source in the radial center of the moderator.
FIG. 13 illustrates various parameters of two subcritical reactors.

FIG. 6 illustrates the average neutron flux in moderator 40 as a function of the radial distance from the source 12 (at the radial center of the moderator 40). The source 12 used for the data of FIG. 6 was a 26 mCi $^{252}$Cf source. This source has a neutron emission rate of $1.1\times10^{8}$ neutrons per second. A neutron source of $10^{9}$ neutrons per second was assumed for the calculations. Thermal flux is defined as energy less than 0.05 eV, epithermal plus thermal flux is energy less than 0.5 eV (the cadmium cutoff), and total flux is all neutron energies. The data was generated using a method known as MCNP, which is a Monte Carlo N-Particle Transport method described by J. F. Breismeister, at the Los Alamos National Laboratory.

As illustrated in FIG. 6, placement of sample chambers 16 close to source 12 optimizes the thermal, epithermal, and total neutron flux in chambers 16. In the example of this description, the optimization is for a neutron source that emits $10^{9}$ neutrons per second. The results scale linearly for other source strengths.

Although the above description is in terms of a moderator assembly 40 especially designed for DNAA of ex situ geological samples, it should be understood that moderator assembly 40 could be used for any application that calls for an irradiated sample. The moderator's ability to irradiate a controlled sample with a controlled flux makes it desirable for a wide variety of nuclear activity analysis applications.

Sample Analysis

In mathematical terms, the goal of neutron activation analysis (NAA) is to determine the atomic number density of the isotope(s) in question, which for purposes of the present invention is $^{197}$Au. Referring again to FIGS. 1 and 2, the sample is irradiated in the neutron flux field of moderator assembly 10 to create a radioactive isotope, $^{198}$Au. During detection, the sample vials 14 are placed proximate to detector 18. For example, the samples could be placed a distance of 0.9 cm from a detector crystal of approximately 2 inches in diameter. For purposes of example herein, detector 18 is a high-purity intrinsic germanium (HPGe) detector. Detector 18 obtains a radiation signal, which is analyzed by analyzer 26. This method is a "delayed" NAA method, in the sense that the sample is first irradiated, then the radiation signal is detected. This method is distinguishable from the "prompt" NAA method, in which the radiation is detected as the sample is being irradiated.

Thus, delayed NAA can be considered in three phases: irradiation of the sample in a neutron flux field to create a radioactive isotope, measurement of the sample activity level in the radioactive isotope, and determination of the sample concentration in the isotope of interest.

For the following description, neutron energy group-averaged quantities are assumed for a single neutron group. It is further assumed that the following quantities are known:

$\phi$=volume-averaged neutron flux in the sample chamber $^{197}\sigma_a$=averaged neutron absorption cross section for $^{197}$Au It is also assumed that the sample does not strongly affect the neutron field flux, that is, that it contains no strong neutron absorbers in sufficient quantity to significantly perturb the neutron flux field.

The rate at which $^{198}$Au atoms are created in the sample per unit volume is:

$$r=\phi\cdot{}^{197}\sigma_a\cdot{}^{197}n \tag{1}$$

, where $^{197}$n is the atomic concentration of $^{197}$Au in the sample.

From Equation (1), a first order differential equation for the time rate of change of the $^{198}$Au atomic concentration in the sample during irradiation is:

$$\frac{d({}^{198}n(\tau))}{d\tau} = -\lambda\ {}^{198}n(\tau) + r \tag{2}$$

, where $^{198}$n(τ) is the time-dependent atomic concentration of $^{198}$Au in the sample, λ is the radioactive decay constant for $^{198}$Au, and τ is the irradiation time.

Equation (2) can be solved to determine $^{198}$n(τ):

$${}^{198}n(\tau)=r/\lambda(1-e^{-\lambda\tau}) \tag{3}$$

The activity of the sample as a function of irradiation time is:

$$A(\tau)=r(1-e^{-\lambda\tau})V \quad (4)$$

, where V is the sample volume. For a given value of $\tau$, Equation (4) provides the activity level of the sample.

Next, the activity level is related to measurable quantities. Referring again to FIG. 1, the decay of $^{198}$Au produces a 412 keV gamma ray in 95.5 percent of the disintegrations. This is a signature radiation that may be used to detect gold.

Analyzer 26 counts gamma rays from the decay of $^{198}$Au in the 412 keV photopeak over a counting interval. The count, I, may be a result of subtracting background counts from total counts. This measured quantity, I, may be expressed as:

$$I = \int A(\tau)\cdot\varepsilon\cdot e^{-\lambda\tau}dt = \frac{A(\tau)\cdot\varepsilon}{\lambda}(e^{-\lambda tl}-e^{-\lambda th}) \quad (5)$$

, where the integration is from $t_l$, the time after the end of irradiation at which the counting interval begins, to $t_h$, the time after the end of irradiation at which the counting interval ends. The total counting efficiency $\epsilon$ is the product of the following efficiencies: the efficiency for decay of $^{198}$Au to produce a 412 keV gamma ray (0.955), the geometric efficiency of the sample/detector arrangement, the intrinsic efficiency for the detector at 412 keV, and the efficiency for the 412 keV gamma ray to escape the sample without interaction.

The counting interval ($t_l$ to $t_h$) need not begin immediately after the end of irradiation; in some cases, it may be desirable to allow the sample to decay for a time to permit isotopes with short half-lives (isotopes other than $^{198}$Au) to disintegrate. These isotopes may result in compton effects in detector 18, which increases background at 412 keV and makes the measurement less certain. Examples of such isotopes are sodium and manganese, $^{24}$Na and $^{56}$Mn.

By combining Equations (1), (4), and (5), a relationship between $^{197}$n and the measured number of counts, I, can be established:

$$^{197}n = \frac{I\lambda}{\varphi\,^{197}\sigma_a\varepsilon V}(1-e^{-\lambda\tau})^{-1}(e^{-\lambda tl}-e^{-\lambda th})^{-1} \quad (6)$$

Many of the parameters in Equation (6) are either one-group parameters, such as $\phi$ and $^{197}\sigma_a$, or are specific to the detector/sample arrangement, such as $\epsilon$. In either case, these quantities are difficult to quantify based on first principles. As an alternative to using detailed calculations to quantify these parameters, Equation (6) may be rearranged so that they are lumped into a single constant, which may be experimentally determined. The rearranged Equation (6) is:

$$^{197}n=k\cdot I(1-e^{-\lambda\tau})^{-1}(e^{-\lambda tl}-e^{-\lambda th})^{-l} \quad (7)$$

The following section discusses determination of a value for the experimentally determined constant, k.

Sample Analysis; Value of k; Experimental Results

The following discussion is of two types of experiments, using the delayed neutron activity analysis (DNAA) techniques that are the subject of the invention. As explained below, the experiments were used to determine a value of k for Equation (7).

For these experiments, the moderator and detector configurations are those described above in connection with FIGS. 2–6. Thus, the moderator was the same as moderator 40 with a polyethylene medium. The detector was an HPGe detector. The neutron source was $Cf^{252}$ with no multiplying media. The use of a multiplying media would improve the results.

FIG. 7 illustrates the results of a first set of experiments. These experiments measured gold concentrations in $SiO_2$ samples doped with a known amount of dilute gold chloride solution. This type of sample represents optimum conditions for system performance—an absence of strongly interfering species such as sodium or manganese.

The standard deviation, $\sigma_I$, on the measured number of counts, I, can be assumed to have two elements: (1) errors due to fluctuations in the number of radioactive emissions during the counting period, $\sigma_{st}$, and (2) errors due to estimating the number of background counts under the photopeak, $\sigma_{bg}$. The quantity $\sigma_{st}$ can be estimated as the square root of I; $\sigma_{bg}$ can be estimated from instrument specifications. Because I is estimated by subtracting background counts from total counts, the standard deviation of I is estimated by adding the two error values in quadrature as follows:

$$\sigma_I=(\sigma_{st}^2+\sigma_{bg}^2)^{1/2}$$

The standard deviation of k, $\sigma_k$, is calculated by equating its fraction error with that of I, as follows:

$$\sigma_k=\sigma_I/I\,k$$

The inverse variance-weighted average value of k and the standard deviation of k can be estimated using known statistical analysis methods. The values from the last column of FIG. 7 indicate that the method yields results that have relative errors of less than about 60 percent down to the 10 ppb level, with no strongly interfering species present.

The level of detection in this case is limited by the background count rate at 412 keV, which was measured at 22±1 counts per hour, as well as by the count rate at 412 keV due to compton effects from activated trace contamination decays, which was measured at 29±1 counts per hour for these samples (with no cooling time).

FIG. 8 illustrates the results of a second set of experiments, which measured gold concentrations in United States Geological Survey (USGS) standard samples. These samples represent realistic conditions for system performance—in the presence of interfering species such as sodium or manganese. In FIG. 8, each of three samples is shown with its USGS sample designation and certified gold concentration.

For purposes of the experiments of FIG. 8, the gold concentration was treated as an unknown and the value of k was assumed to be the value determined in the above-described experiments that used doped $SiO_2$ samples. The standard deviation of I was calculated by adding the standard deviations from background subtraction and statistical deviation of decays during the counting interval in quadrature. The standard deviation on the final estimate of gold concentration was calculated by adding the relative standard deviations for I and k in quadrature.

As indicated by FIG. 8, there is good agreement between reference and measured values of gold concentration in the USGS samples. Because of this agreement and because the measured concentrations were not consistently smaller than known concentrations, it follows that the USGS samples did not significantly affect the neutron flux field, as compared to the doped $SiO_2$ samples. Thus, interfering species did not significantly affect the neutron flux fields, and the value of k calculated from doped $SiO_2$ samples is appropriate for use with actual geologic samples.

Subcritical Reactor

As stated above, the purpose of a subcritical reactor is to provide a source of neutrons that is more powerful than a neutron emitter alone. A moderator assembly, such as moderator assemblies 10 and 40, may be modified to provide a subcritical reactor. This is achieved by embedding a multiplying material within the moderating material. Like moderator assembly 40, the subcritical reactor described below is suitable for activating samples for applications other than geological analysis.

Polyethylene is a suitable moderating material for the following reasons: (i) it has a large hydrogen concentration, (ii) it is a solid at room temperature, (iii) it has low cost, (iv) it is easy to fabricate, and (v) it minimizes the size of the subcritical reactor. Since polyethylene has a large hydrogen concentration, it is able to slow down neutrons from their birth energies in a short distance, limiting the size of the subcritical reactor which is an advantage for portability. A solid-state moderator is also advantageous for portability.

Natural uranium metal is a suitable multiplying material. It may be more suitable than enriched uranium for the following reasons: (i) its relatively greater availability and low expense, and (ii) its inability to be formed into a critical arrangement with hydrogenated materials as the moderator.

The following description is in terms of computer-aided models of a subcritical reactor. The polyethylene was modeled as having a density of 0.955 g/cm$^3$. The uranium metal was modeled as having a density of 19.0 g/cm$^3$. The relative isotopic composition of the uranium was assumed to be 99.2745 percent $^{238}$U, 0.7200 percent $^{235}$U, and 0.0055 percent $^{234}$U.

Figure 9:
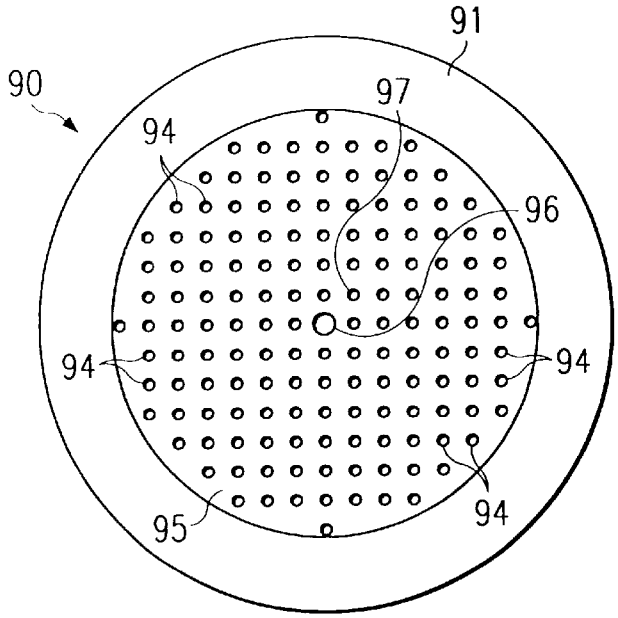
FIGS. 9 and 10 are a top view and side view, respectively, of a subcritical reactor.
Figure 10:
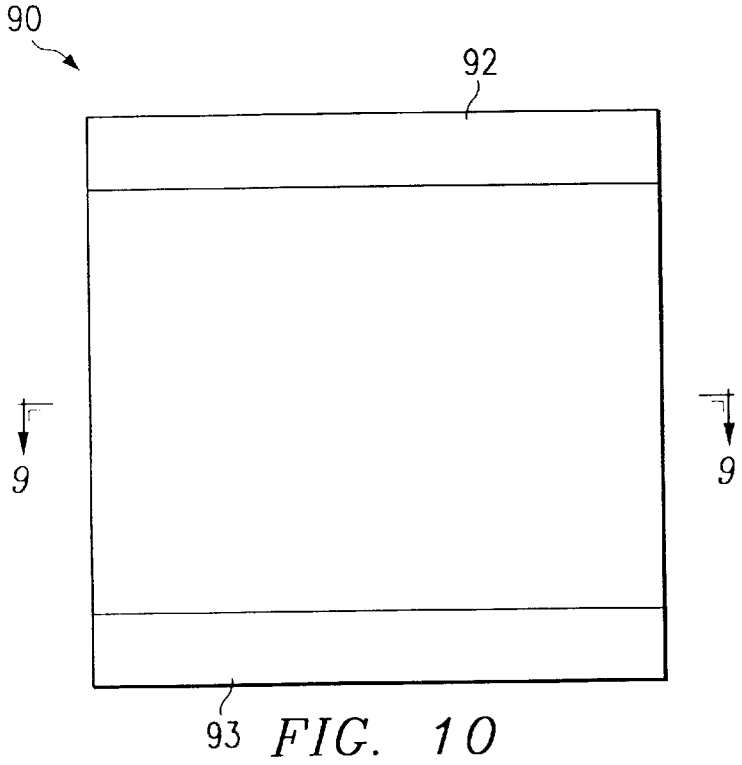

FIGS. 9 and 10 are a top view and side view, respectively, of a subcritical reactor 90. A right-cylinder with height equal to diameter (hereafter referred to as a right-square cylinder) is suitable for several reasons: (i) it is a stable shape for transportation while having a reasonably small surface area to volume ratio, and (ii) it is easy to machine. An outer polyethylene "blanket" 91 surrounds the perimeter of the moderator assembly 90. A top piece 92 and bottom piece 93 are at the top and bottom of the assembly 90. The blanket thicknesses are the minimum thicknesses necessary for obtaining maximum reflection of neutrons back into the subcritical reactor.

Uranium fuel rods 94 are arranged in a rectangular grid, embedded in the core area 95 of the polyethylene moderating material. The center rod is omitted to allow for insertion of the neutron source 96. One or more of the fuel rod locations is used as a sample chamber 97.

Figure 11:
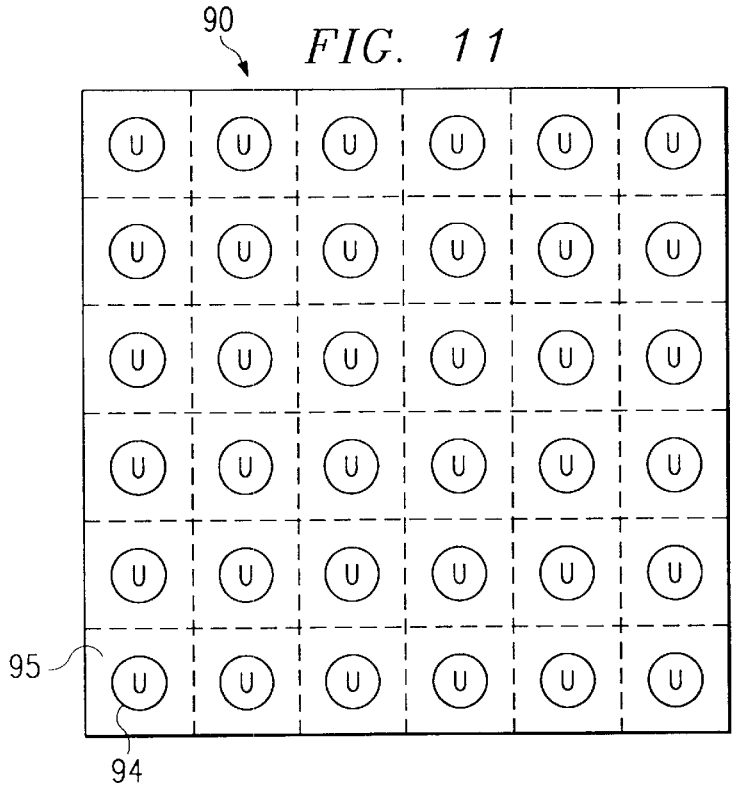
FIG. 11 is a cross-sectional view of the subcritical reactor of FIGS. 9 and 10.

FIG. 11 is a cross sectional view of a portion of the subcritical reactor 90. In the example of FIG. 11, each grid element is 2.54 cm×2.54 cm. Each fuel rod 94 is 1.72 cm in diameter. An analysis of $k_\infty$ may be used to determine the optimal grid spacing and fuel rod size.

Figure 12:
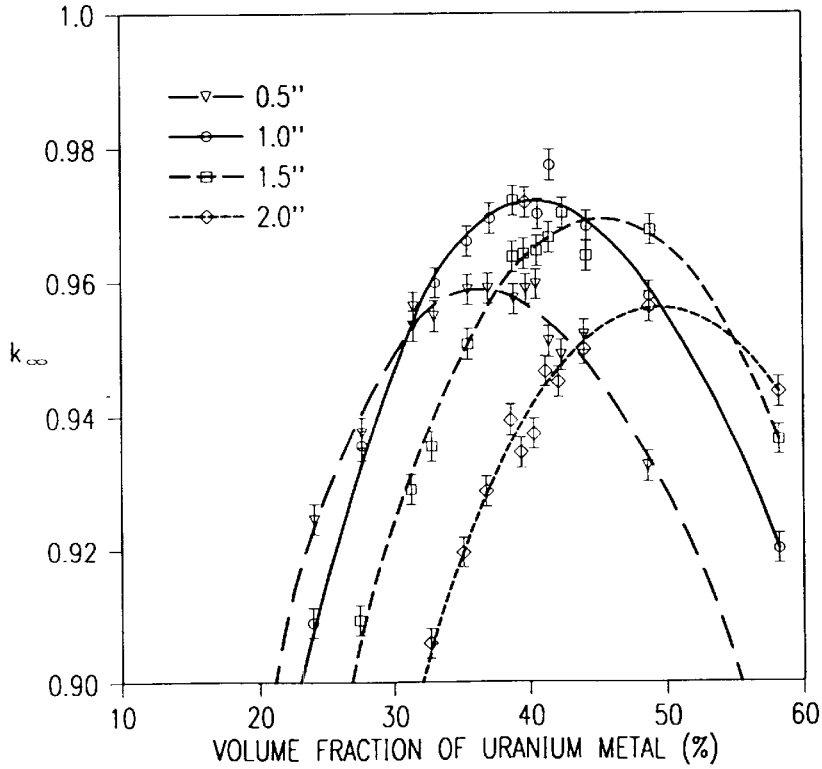
FIG. 12 is a plot of $k_\infty$ as a function of volume fraction of uranium metal where the remainder of the volume is polyethylene.

FIG. 12 is a plot of $k_\infty$ as a function of volume fraction of uranium metal where the remainder of the volume is polyethylene. Four different grid spacings (i.e., the center to center distance of consecutive fuel rods) were examined: 1.27, 2.54, 3.81, and 5.08 cm (0.5, 1.0, 1.5, and 2.0 inches). The volume fraction of uranium was changed by varying the fuel rod diameter. As can be seen from FIG. 12, $k_\infty$ can be maximized with a grid spacing of 2.54 cm.

A volume fraction of 0.360 was chosen for the subcritical reactor 90. This volume fraction is not exactly at the peak of the $k_\infty$ curve for a 2.54 cm grid, however, this location on the curve has a corresponding $k_\infty$ that is within one percent of the maximum and represents a ten percent weight savings over the peak location. This volume fraction corresponds to a rod diameter of 1.72 cm for a 2.54 cm grid spacing.

The neutron flux in sample chamber 97 is roughly proportional to $1/(1-k_{eff})$ Thus, the largest value of $k_{eff}$ that can be achieved is desired, given the restriction that the moderator 90 is to be sufficiently small so as to be field portable. Maximization of $k_{eff}$ minimizes the amount of uranium in the subcritical reactor 90, and hence its hence size and weight.

FIG. 13 illustrates various parameters of two subcritical reactors 90. A smaller and a larger reactor have a $k_{eff}$ of approximately 0.8 and 0.9, respectively. Because the factor by which the flux in sample chamber 97 is amplified by the multiplying material is roughly proportional to $1/(1-k_{eff})$, the higher value of $k_{eff}$ is preferred. However, the weight of the larger reactor 90 (3,059 kg versus 692 kg for the smaller assembly) may limit its field portability.

Analytic methods may be used to determine an optimal location for the sample chamber 97 relative to the neutron source 96. An optimal location is one that is sufficiently close to the neutron source 96 so as to be within a strong neutron field, but sufficiently distant to permit neutrons to be moderated and hence absorbed.

A sample chamber 97 having a volume of about ten cubic centimeters is adequate for activating a sufficient number of gold atoms for detection to the limits of economic importance. This volume is large enough for the sample to contain a sufficient number of gold atoms yet not so large as to significantly perturb the neutron flux level in the assembly. The sample chamber 97 modeled herein is a right-cylinder with a diameter of 2.0 cm and a height of 4.0 cm, with the volume averaged neutron flux inside that volume being the optimized quantity.

The neutron source 96 may be modeled as a maxwellian fission energy spectrum having the following probability density function:

$$p(E)=CE^{1/2}\exp(-E/a)$$

, where E is the neutron birth energy, C is a proportionality constant, and a is a shape parameter. A value of 1.2895 MeV for the shape parameter is appropriate for modeling the neutron energy spectrum from $^{252}$Cf.

Computer-aided neutron analysis tools, such as tools using MCNP estimation methods, may be used to estimate the volume averaged neutron fluence per unit source particle plus its progeny. When there is no multiplying media, the volume averaged neutron flux for a particular application is then determined by multiplying that estimation by a source strength (the number of neutrons per second emitted from the source). The result of this multiplication is the rate at which fluence is delivered to the sample chamber 97, which is one definition of flux. When multiplying media is present, the determination of the volume averaged neutron flux from the MCNP estimation is not so straightforward; contributions from one source particle's progeny can coincide (as opposed to being consecutive) with future particles' contributions to the volume averaged neutron fluence.

An enhanced means for estimating volume averaged neutron flux can be used when multiplying material is present, provided that the source rate is larger than the inverse of the mean neutron lifetime. For purposes of this description, mean neutron lifetimes are assumed to be about 0.2 milliseconds, and typical neutron source rates are assumed to be on the order of $10^8$ to $10^9$ neutrons per second.

Figure 14:
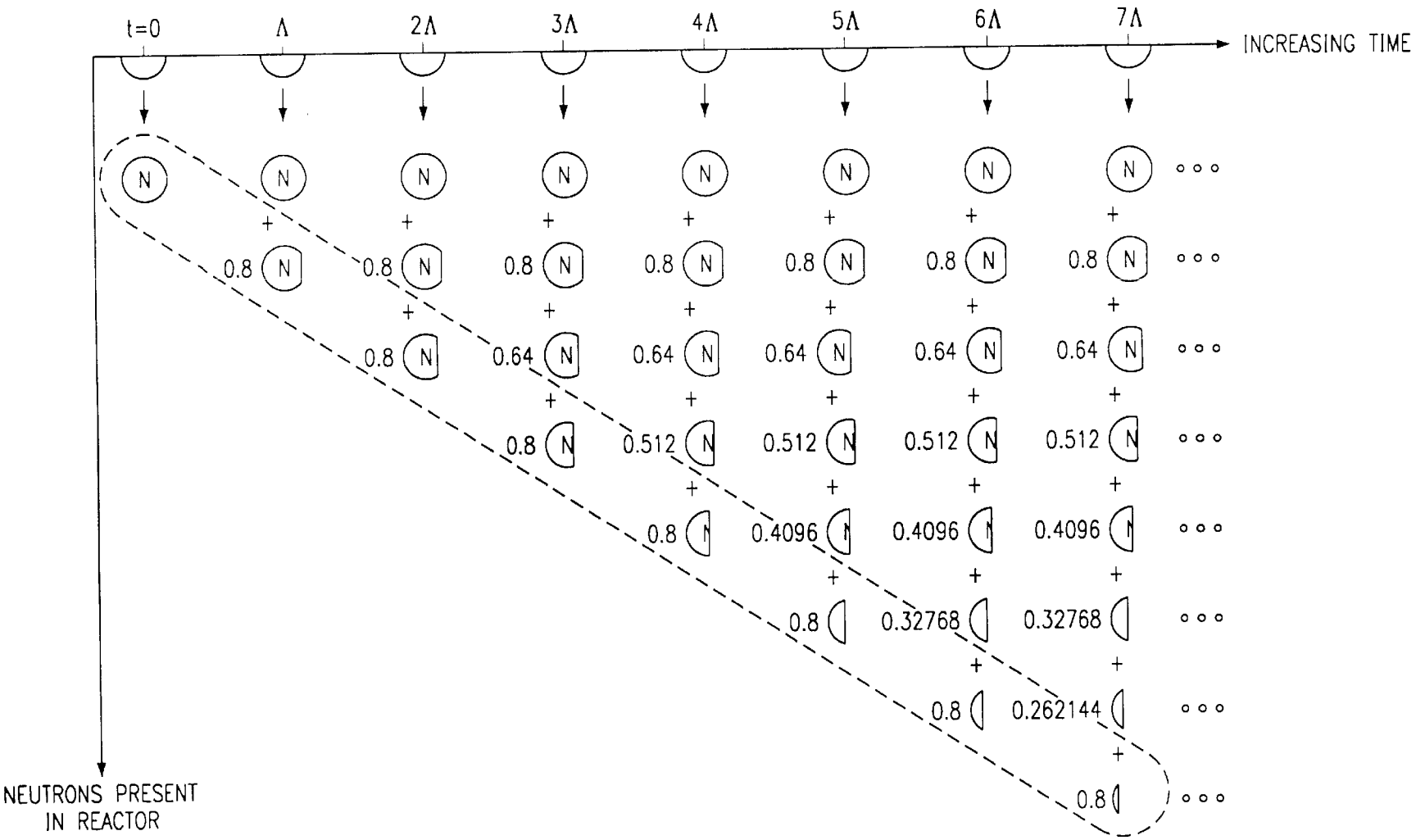
FIG. 14 illustrates neutrons as a function of time, where $k_{eff}$ is 0.8 and the neutron source emits one neutron every mean neutron lifetime, $\Lambda$.

FIG. 14 illustrates neutrons as a function of time, where $k_{eff}$ is 0.8 and the neutron source emits one neutron every mean neutron lifetime, A. The fluence from the source neutron plus its progeny is the fluence in the shaded area of FIG. 14.

The quantity of interest is the fluence per unit time (i.e., the flux) in sample chamber 97. Once a steady state condition has been reached, there is a total of one less than $1/(1-k_{eff})$ progeny contributing simultaneously to the flux for every source neutron. The effect of the simultaneous deposition of fluence is that a source neutron is amplified by a factor of $1/(1-k_{eff})$. Thus, to estimate the neutron flux in the sample chamber 97, the fluence-per-source-particle-plus-progeny is multiplied by the source rate and by $1/(1-k_{eff})$.

Computer-aided neutron analysis tools may be used to estimate flux in terms of discrete energy bins, with the estimated flux being the volume averaged neutron fluence per source particle plus progeny per unit energy integrated over the energy bin. The neutron flux, averaged per unit volume and energy bin, in $cm^{-2}$ $MeV^{-1}$, is given by the following equation:

$$\Phi = \frac{10^9}{1-k_{eff}} \int_{E=E_1}^{E=E_u} \int_{v} \int_{t=\varnothing}^{t=\infty} \varphi(E, \bar{r}, t) dt \frac{dV}{V} dE$$

, where $E_u$ is the upper energy level of the bin, $E_l$ is the lower energy level of the bin, $\phi(E, r, t)$ is the neutron flux per unit energy per unit time per source particle plus progeny in $cm^{-2}$ $s^{-1}$ $MeV^{-1}$, t is time in s, E is energy in MeV, and V is volume in $cm^3$.

Figure 15:
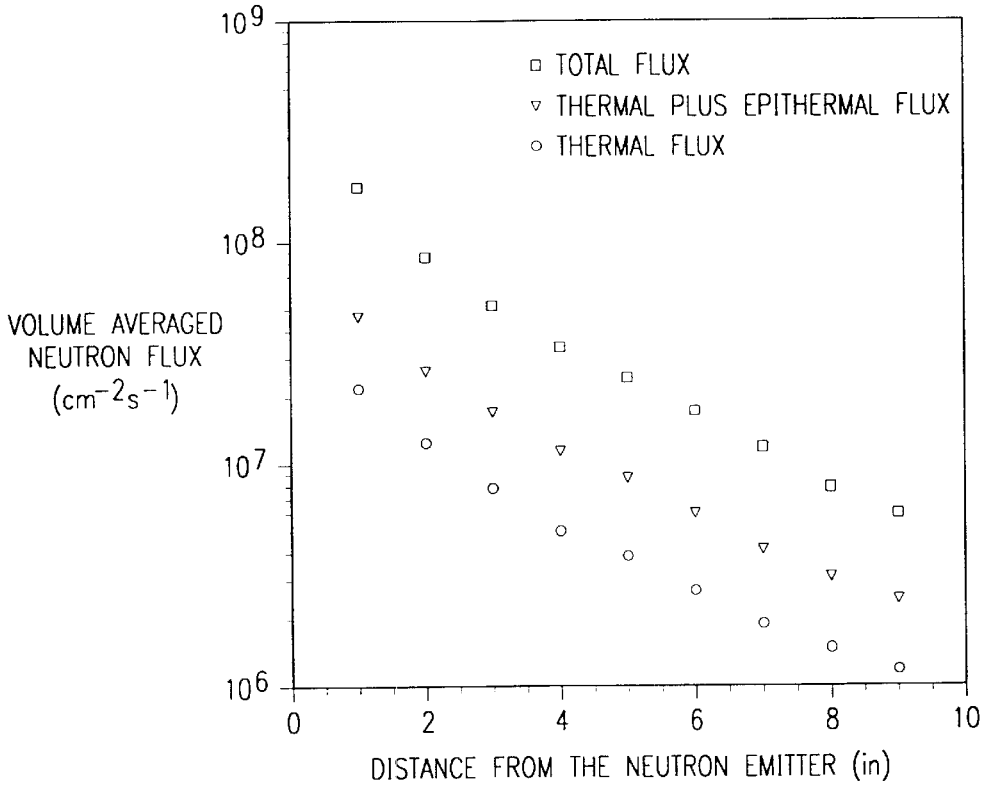
FIGS. 15 and 16 illustrate volume averaged neutron flux as a function of distance from the centers of the smaller and larger moderator assemblies of FIG. 13, respectively.
Figure 16:
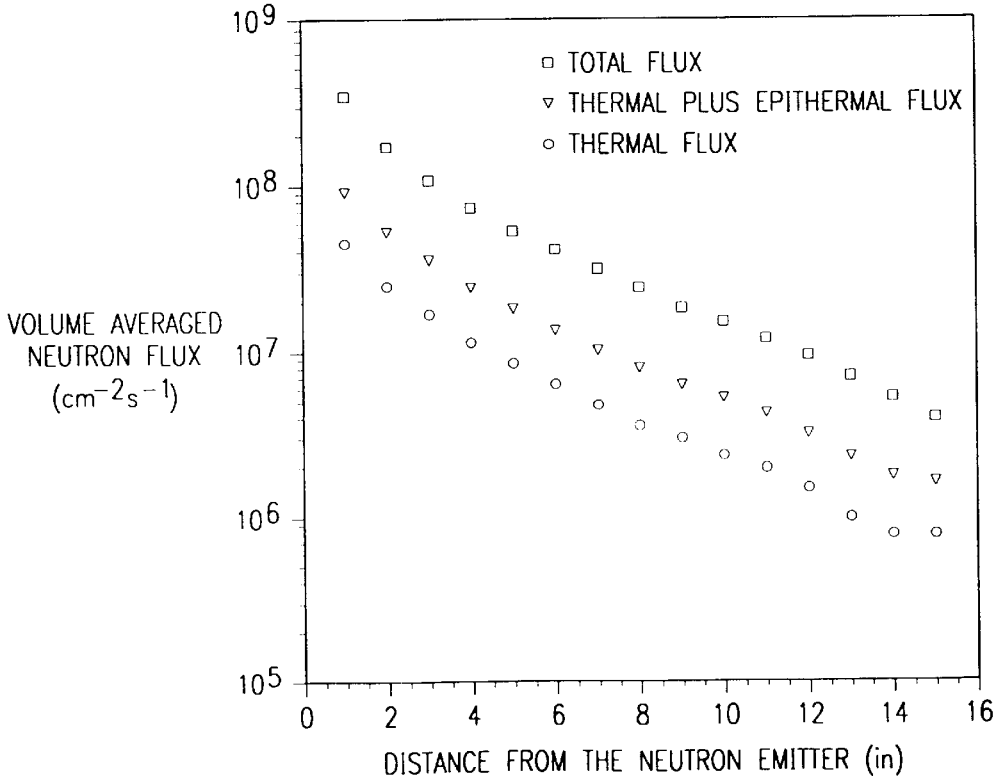

FIGS. 15 and 16 are plots of the thermal (i.e., neutron energy less than 0.05 eV), thermal plus epithermal (i.e., as defined by the cadmium cutoff where neutron energy is less than 0.5 eV), and total flux as a function of distance from the neutron source 96. The reactors that are the basis for these plots are the smaller and larger reactors 90 described in FIGS. 9–13, with FIG. 15 representing the smaller reactor and FIG. 16 representing the larger reactor of FIG. 13. The neutron source 96 is at the center of the reactor 90, and is assumed to provide $10^9$ neutrons per second. The sample chamber 97 is assumed to be filled with air and on the same horizontal plane as the neutron source 96. FIGS. 15 and 16 indicate that placing the sample chamber 97 at the center of the reactor 90 maximizes the total, epithermal, and thermal fluxes.

Using one of the fuel rod locations for the sample chamber 97, the chosen location for the sample chamber 97 was at 2.54 cm radially outward from the neutron source 96. At this location and assuming a neutron source rate of $10^9$ neutrons per second, for the smaller reactor 90, the volume averaged neutron flux in the sample chamber 97 is $1.72\times10^8$ $cm^{-2}$ $s_{-1}$ total flux, $4.47\times10^7$ $cm^{-2}$ $s^{-1}$ thermal flux (i.e., energy less than 0.05 eV). For the larger reactor 90, the volume averaged neutron flux in the sample chamber 97 is $3.43\times10^8$ $cm^{-2}$ $s^{-1}$ total flux, $9.09\times10^7$ $cm^{-2}$ $s^{-1}$ thermal plus epithermal flux, and $4.37\times10^7$ $cm^{-2}$ $s^{-1}$ thermal flux.

Other Embodiments

Although the present invention has been described in detail, it should be understood that various changes, substitutions and alterations can be made hereto without departing from the spirit and scope of the invention as defined by the appended claims.

What is claimed is:

1. A method of computing the atomic number density, $^{197}n$, of gold ($^{197}Au$) in a sample of material, comprising the steps of:

assembling a moderator assembly having a neutron source and a sample chamber; and a moderating medium surrounding the said neutron source and the said sample chamber:

forming a fixed geometry of the sample;

activating the sample by placing the sample in the sample chamber for a known irradiation time, thereby creating a radioactive isotope;

removing the sample from the sample chamber;

shielding the sample from the neutron source;

placing the sample proximate a radiation detector;

counting the rays emitted by the delayed decay of the radioactive isotope during a counting interval, thereby obtaining a count value, I,; and calculating the value of $^{197}n$ as follows:

$$^{197}n = \frac{I\lambda}{\varphi\, ^{197}\sigma_a \epsilon V}(1-e^{-\lambda\tau})^{-1}(e^{-\lambda\tau l} - e^{-\lambda\tau h})^{-1}$$

, where $\lambda$ is the decay constant, $\phi$ is the neutron flux in the sample chamber, $^{197}\sigma_a$ is the neutron absorption cross section for $^{197}Au$, $\epsilon$ is a counting efficiency value, V is the sample volume, and $\tau$ is the irradiation time from $\tau 1$ to $\tau h$.

2. The method of claim 1, wherein the moderator assembly further has a multiplying medium and is a subcritical reactor.

3. The method of claim 1, wherein the neutron source is californium.

4. The method of claim 1, wherein the fixed geometry is cylindrical.

5. The method of claim 1, wherein the sample is powdered and mixed prior to the step forming a fixed geometry.

6. The method of claim 1, wherein the fixed geometry has a uniform cross section.

7. The method of claim 1, wherein the neutron flux represented by the constant is a volume averaged neutron flux.

8. The method of claim 1, wherein the moderating assembly further has a polyethylene moderating medium.

9. The method of claim 1, wherein the counting efficiency value represents at least the efficiency of decay of the element of matter.

10. The method of claim 1, wherein the counting efficiency value represents at least the geometric efficiency of the sample and detector.

11. The method of claim 1, wherein the counting efficiency value represents at least the efficiency of the detector.

12. The method of claim 1, wherein the counting efficiency value represents at least the efficiency for radiation to escape the sample without detection.

13. The method of claim 2, wherein the moderator assembly has a solid unit of moderating material and the multiplying medium comprises pieces of material inserted into the moderating material.

14. The method of claim 1, further comprising the step of experimentally determining a constant representing one or more of the following values: $\phi$, $^{197}\sigma_a$, V, and $\epsilon$; and of using the constant in place of one or more those values during the calculating step.

* * * * *